US005416682A

United States Patent [19]

Bromhall

[11] Patent Number: 5,416,682

[45] Date of Patent: May 16, 1995

[54] BULB SUPPORTING DEVICE

[75] Inventor: Adrian V. Bromhall, Wolverhampton, England

[73] Assignee: Britax Vega Limited, England

[21] Appl. No.: 269,886

[22] Filed: Jul. 1, 1994

[30] Foreign Application Priority Data

Jul. 13, 1993 [GB] United Kingdom ..... 9314468

[51] Int. Cl.[6] ..... F21V 29/00

[52] U.S. Cl. ..... 362/294; 362/61; 362/345; 362/373

[58] Field of Search ..... 362/61, 80, 226, 294, 362/345, 373, 306

[56] References Cited

U.S. PATENT DOCUMENTS 2,219,770 10/1940 Falge et al. ..... 439/271
2,824,214 2/1958 Bertsche ..... 362/273
4,563,730 1/1986 Saito ..... 362/294 X
4,564,891 1/1986 Daumüller et al. ..... 362/294
5,095,410 3/1992 Nagengast et al. ..... 362/61

FOREIGN PATENT DOCUMENTS 1116087 10/1961 Germany .

*Primary Examiner*—Stephen F. Husar
*Attorney, Agent, or Firm*—Davis, Bujold & Streck

[57] ABSTRACT

A bulb supporting device of a vehicle lamp assembly consists of a socket, a resilient gasket having a first surface abutting an annular surface within the socket, and a bulb holder having an annular flange with a surface abutting a second surface of the gasket. The gasket has two annular ribs on one of its surfaces with openings at circumferentially spaced locations to provide a labyrinth-type flow path for air to enter and exit the interior of the lamp assembly.

3 Claims, 1 Drawing Sheet

BULB SUPPORTING DEVICE

FIELD

This invention relates to a bulb supporting device comprising a socket in a vehicle lamp assembly, a resilient gasket having a first surface abutting an annular surface within the socket, and a bulb holder having an annular flange with a surface abutting a second surface of the gasket.

RELATED ART

A retainer arrangement of this type is disclosed in U.S. Pat. No. 2,219,770. It is also known from U.S. Pat. No. 5,095,410 to provide a retainer arrangement for maintaining a bulb assembly within a socket in a vehicle lamp and arranged to established a labyrinth-type flow path for air to enter and exit the interior of the lamp assembly, the bulb assembly having an annular flange with a surface arranged to confront a complimentary surface on the lamp assembly to bound said labyrinth-type flow path.

SUMMARY OF THE INVENTION

According to the invention, in a bulb supporting device of the type described above, the gasket has formations bounding a labyrinth-type flow path for air to enter and exit the interior of the lamp assembly.

DETAILED DESCRIPTION OF THE PREFERRED EMBODIMENT

Figure 1:
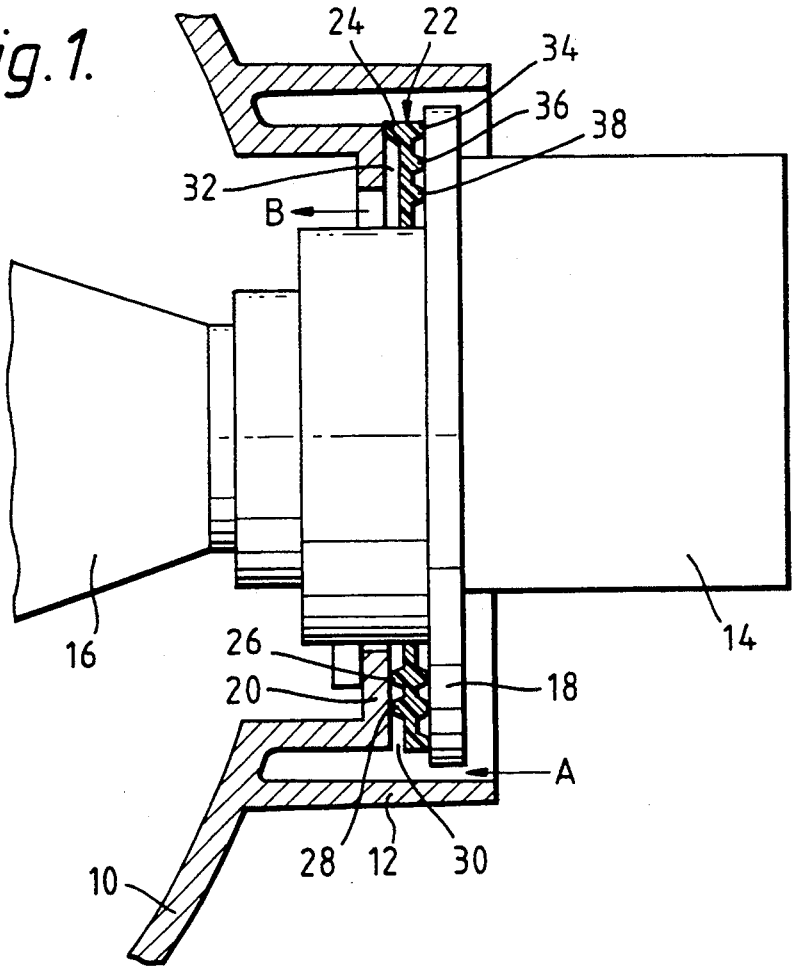
FIG. 1 is a sectional view of a retainer arrangement in accordance with the invention, having a gasket between the lamp assembly and the bulb assembly.

A vehicle lamp assembly has a body 10 with a cylindrical socket 12 for receiving a bulb holder 14. The bulb holder 14 supports a bulb 16 and has an annular flange 18 which confronts a complimentary inwardly-directed flange 20 formed within the socket 12. A synthetic rubber gasket 22 is located between the flanges 18 and 20.

Figure 2:
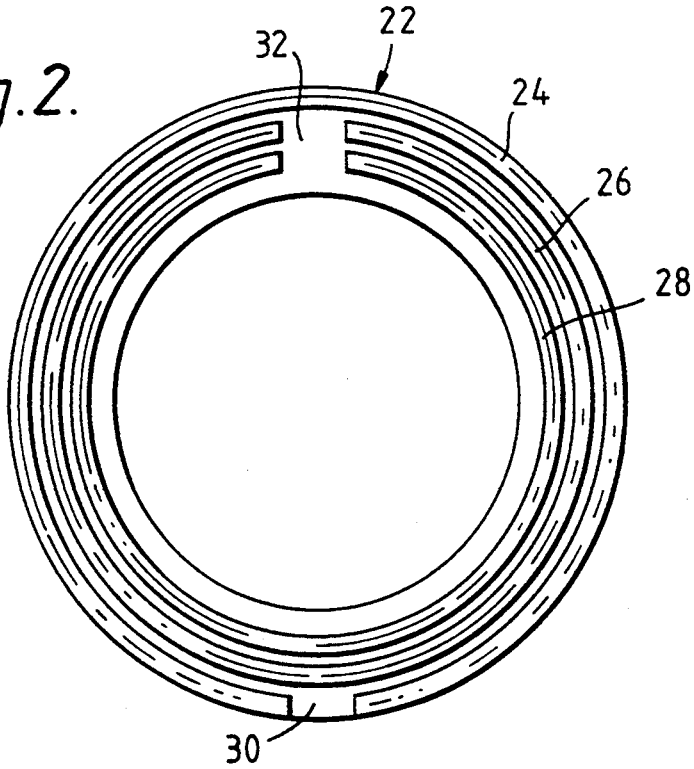
FIG. 2 is a side view of the gasket of the retainer arrangement shown in FIG. 1.

As can best be seen from FIG. 2, the gasket 22 has three concentric annular ribs 24, 26 and 28 on the surface confronting the flange 20. The outer rib 24 is cut away at the bottom of the gasket 22 to form an air inlet 30. Similarly, the central and inner ribs 26 and 28 are cut away at the top of the gasket 22 to form an air outlet 32. In use, air can flow into the bottom of the socket 12, as indicated by arrow A in FIG. 1, then up through the inlet 30, round the groove between the outer rib 24 and central 26 and then through the outlet 32 into the interior of the body 10 as indicated by the arrow B. The groove between the central rib 26 and inner rib 28 has no communication with the inlet 30 and therefore does not form part of the labyrinth flow path.

As can be seen in FIG. 1, the gasket 22 has three annular ribs 34, 36 and 38 formed on its opposite face so as to abut the flange 18 on the bulb holder. In the embodiment illustrated, these three ribs do not have any portion cut away and do not form part of the air flow path. However they may be constructed to form a second, parallel, air flow path if it is desired to increase the air flow rate.

I claim:

1. A bulb supporting device comprising a socket in a vehicle lamp assembly, a resilient gasket having a first surface abutting an annular surface within the socket, and a bulb holder having an annular flange with a surface abutting a second surface of the gasket, wherein the gasket has formations bounding a labyrinth-type flow path for air to enter and exit the interior of the lamp assembly.

2. A bulb supporting device according to claim 1, wherein the formations bounding the labyrinth-type flow path comprises a plurality of annular ribs on one of said surfaces of the gasket.

3. A bulb supporting device according to claim 2, wherein the ribs have openings at circumferentially spaced locations to provide radially extending parts of said flow path.

* * * * *